US009863743B2

(12) United States Patent
Gall

(10) Patent No.: US 9,863,743 B2
(45) Date of Patent: Jan. 9, 2018

(54) ANNULAR ARROW FLETCH

(71) Applicant: Timothy Lee Gall, Morgan Hill, CA (US)

(72) Inventor: Timothy Lee Gall, Morgan Hill, CA (US)

( * ) Notice: Subject to any disclaimer, the term of this patent is extended or adjusted under 35 U.S.C. 154(b) by 651 days.

(21) Appl. No.: 13/776,480

(22) Filed: Feb. 25, 2013

(65) Prior Publication Data

US 2014/0243123 A1 Aug. 28, 2014

(51) Int. Cl.
*F42B 6/06* (2006.01)
*F42B 10/36* (2006.01)

(52) U.S. Cl.
CPC ..... *F42B 6/06* (2013.01); *F42B 10/36* (2013.01)

(58) Field of Classification Search
CPC ..... F42B 10/36; F42B 10/00; F42B 10/34; F42B 10/02; F42B 10/06; F42B 6/06; F42B 6/00; F42B 10/04
USPC ..... 473/578, 579, 585, 586; 124/1, 80; 446/473
See application file for complete search history.

(56) References Cited

U.S. PATENT DOCUMENTS 1,424,672 A 8/1922 Ogdpeek
3,746,334 A 7/1973 Stubblefield
3,815,916 A * 6/1974 Meszaros ..... 473/586
3,903,639 A 9/1975 Howell
3,946,519 A 3/1976 Vadik
4,182,513 A 1/1980 Henderson
4,204,307 A * 5/1980 Pfetzing ..... 29/407.09
4,589,778 A 5/1986 Mitchell
4,905,397 A 3/1990 Juelg, Jr.
5,234,220 A 8/1993 Schellhammer
5,311,855 A * 5/1994 Basik ..... 124/44.5
5,439,231 A * 8/1995 Roberts et al. ..... 473/586
5,496,041 A 3/1996 Broussard
5,846,147 A 12/1998 Baskj
5,863,250 A 1/1999 Harris
5,919,105 A * 7/1999 Summers ..... 473/578
5,951,419 A 9/1999 Cameneti
6,123,631 A * 9/2000 Ginder ..... 473/570
6,179,736 B1 1/2001 Thurber
(Continued)

*Primary Examiner* — John E Simms, Jr.
(74) *Attorney, Agent, or Firm* — David Crites

(57) ABSTRACT

The invention is an annular arrow fletch arrow stabilizer are therefor provided. The annular arrow fletch is used for; stabilizing arrow flight, providing better clearance and functionality then conventional fixed glued tail feathers, the invention can be used with light emitting diode arrow nocks. The invention improves current arrow shaft stabilization technology with reduced assembly labor cost, the elimination of facial and or face mask interference issues providing more clearance, improved accuracy, repeatable production with the consistent injection mold production of the annular arrow fletch, easy replacement of the annular arrow fletch in the field, and improved arrow storage. The annular arrow fletch incorporates a metallic contact point, which will work with all light emitting nocks. The design of the annular arrow fletch is so that it is affixed to an arrow by an arrow nock and comprises of an annular wing, a central elongated cylindrical cylinder with a cap and a plurality of fins with micro-groves and a metal contact. In use, the annular arrow fletch is affixed at the aft end of the arrow by an arrow nock prior to launch.

18 Claims, 1 Drawing Sheet

(56) References Cited

U.S. PATENT DOCUMENTS

| | | | | |
|---|---|---|---|---|
| 6,220,918 | B1 * | 4/2001 | Laronge | 446/63 |
| 6,454,623 | B1 | 9/2002 | Flatau | |
| 6,695,727 | B1 | 2/2004 | Kuhn | |
| 6,736,742 | B2 | 5/2004 | Price | |
| 7,331,886 | B2 | 2/2008 | Morris | |
| 7,931,550 | B2 * | 4/2011 | Lynch | 473/578 |
| 8,449,413 | B1 * | 5/2013 | Jackson et al. | 473/578 |
| 8,485,923 | B2 * | 7/2013 | Kozlik et al. | 473/586 |
| 2003/0045381 | A1 * | 3/2003 | Morris et al. | 473/578 |
| 2005/0159256 | A1 * | 7/2005 | Simo et al. | 473/586 |
| 2005/0178375 | A1 * | 8/2005 | Sutherland et al. | 124/79 |
| 2008/0113834 | A1 * | 5/2008 | Harwath et al. | 473/586 |
| 2011/0218063 | A1 * | 9/2011 | Hunt | 473/586 |

* cited by examiner

ANNULAR ARROW FLETCH

CROSS REFERENCE TO RELATED APPLICATION

The listed prior application claims the benefit of U.S. Design patent application 29/421,121, filed: May 25, 2012, the teachings of which are incorporated herein by reference.

FIELD OF THE INVENTION

This invention relates generally to a fletching of an arrow in the field of archery. The annular arrow fletch is to replace the use of natural or man made, synthetic vanes, feathers or fletchings on an arrow shaft.

Definitions

"Fletching" is a generic term used to describe the fins of an arrow that guide and stabilize the arrow during flight. These fins, when made from natural feathers, are commonly referred to collectively as "fletching", comprising individual "fletches." When made from plastic or other man-made materials, these fins are called "vanes." In the present application, the terms "fletching," "feathers," "vanes," and "fins" are employed throughout when describing fins of any type and are used interchangeably.

"Nock" is a generic term used to describe the portion or product of an arrow that when an arrow is placed upon a bow prior to being launched. The nock is the part of the arrow that secures the arrow to the string of the bow before launch, typically by surrounding the bowstring with a notched area.

"Cap" is a term that may be used herein as part of the annular arrow fletch device, which limits the annular arrow fletches depth onto the arrow shaft. This part of the device allows the annular arrow fletch only to be recessed onto an arrow shaft to a predetermined depth.

"Arrow rest" is typically the term for a small protrusion or device on the bow at the point where the arrow will rest during the draw, to hold the arrow away from and reduce contact with the riser (the thick, non-bending center portion of the bow).

A "fall-away rest" is an arrow rest that holds the arrow with an element that "falls away," drops, or otherwise travels away from the arrow when the string is released and the arrow is launched, thereby reducing or eliminating contact between the arrow rest and portions of the arrow itself, e.g., shaft or fletching.

"Mechanical Release" is a devise used by archers to release the bowstring. There are numerous varieties of mechanical releases. Generally the mechanical release is held in the archer's hand and he/she would attach the mechanical release to the bowstring, the arrow is loaded onto the string and the arrow rest. The archer would then pull the bowstring rearward and the mechanical release has a trigger to release the bowstring launching the arrow.

"Lighted nocks" are a light emitting arrow nock, which contain a battery, L.E.D. light emitting diode, and an arrow nock. The lighted nock may or may not have a switch. The lighted nock's intended use is to emit light from the nock after the arrow is shot from the bow.

BACKGROUND OF INVENTION

Arrows typically are fletched on the rear of an arrow shaft to provide flight stability. Usually, three or four fletches are mounted in a circumferentially spaced relationship. The practice of using multiple pieces or individual fletches has remained virtually unchanged over time, wherein each fletch or vane must be glued in place separately, either by hand, or with the aid of tools and or fletching jigs and the required skills. This process is time consuming and introduces inconsistencies in spacing and angles. Minute inconsistencies in the form of unevenly spaced fletching, varying distances from the end of the arrow shaft, and angular variations have a profound effect on the flight of an arrow.

Moreover, polluting and toxic chemicals are often required to clean the arrow shaft prior to gluing.

Further, conventionally fletched arrows are easily damaged in the field or while in storage. When damaged, conventional fletching is normally not considered field replaceable and can be difficult to repair.

Additionally, conventional fletched arrows can make contact with an archers face and or the archer's facemask if he/she were using a hunting facemask to conceal and camouflage their appearance. The unwanted pressure applied to the arrow by the archer's facial cheek or facemask would have an adverse effect on the arrow upon release causing erratic inconsistent arrow flight.

Finally, prior art stabilizing methods require the fletching to pass over and/or through the arrow rest causing possible interference with the rest, thus imposing certain design limitations. Fixed arrow rests may interfere with the flight of an arrow through inadvertent contact, thereby adversely effecting flight performance, as well as damaging the fletching through such contact. While fall-away or offset rests most often are used to reduce the incidence of contact between the arrow rest and the fletching of an arrow, such rests can be expensive and do not resolve other above-mentioned problems associated with fletching, fletching repair and or replacement tools, jigs, required skills and the use of toxic cleaners, glues and adhesives.

SUMMARY OF INVENTION

The present invention provides an affixed annular arrow fletch to an arrow, incorporating a novel aerodynamic design for arrows having a variety of general or specialized uses. This improvement is achieved by the elimination of conventional fixed tail feathers or a sliding stabilizer and employing the use of affixed annular arrow fletch consistent with the present invention.

In one aspect, the improved stabilization of the arrow or other projectile and resolves prior art issues related to facial pressure interference, fletching inconsistency, environmental sensitivity to; cleaners, glues and adhesives, field replaceability, and erratic arrow flight. An annular arrow fletch consistent with the present invention comprises a unit adapted to slide over the aft end of the shaft of an arrow to a predetermined depth, which is then affixed to the arrow shaft by a nock. The present invention's central elongated cylindrical cylinder cap and an arrow nock are used to maintain the union with an arrow shaft and a point make the arrow components.

The present invention provides field replaceable annular arrow fletches that eliminates the inconsistencies and costs associated with traditional multi-piece glue adhesive fletching jig systems. The invention also makes traveling and storage of arrows more convenient because the annular arrow fletch can be removed and reinstalled in field as needed.

The annular arrow fletch consistent with the present invention may easily be mass-produced and is capable of providing high accuracy devices with repetitive results in use. An annular arrow fletch consistent with the present invention may be particularly shaped or otherwise adapted to provide additional aerodynamic features, e.g., increased arrow rotation, improved drag performance, increased arrow stability and or other such flight characteristics.

Further, the present invention provides an arrow having improved aerodynamic characteristics, resulting in increased flight stability, speed, and accuracy. An arrow consistent with the present invention requires no feathers or traditional fletchings, instead utilizing affixed annular arrow fletch improves aerodynamic when mounted over the aft end of the arrow shaft, and is held in place by the arrow nock. When an annular arrow fletch is affixed to an arrow shaft the center elongated cylindrical cylinder structure of the annular arrow fletch allows for greater clearance between the facial flesh of the archers cheek and the invention. The benefit of the additional clearance reduces and or aids in preventing unwanted contact onto the fletching area of an arrow shaft. The unwanted pressure that is applied onto the arrow shaft fletching area will cause erratic arrow flight effecting speed and accuracy of the shot arrow. Further, since the arrow has less unwanted interfering pressures being applied to the arrow the arrow will be initially released and allowed to travel at a higher acceleration rate due to the clean release. The annular arrow fletch design prevents less impact by crosswind drift and wobble because of less surface area to be impaired by the crosswinds on the fletching. The annular arrow fletch uses a center elongated cylindrical cylinder structure with a cap, an annular wing and fins with micro-groves when affixed to a shaft the fletch will stabilize the flight of an arrow. The annular arrow fletch is made of a distinct center elongated cylindrical cylinder structure and an annular wing shape connected by three fins. The center elongated cylindrical cylinder structure is of larger diameter to except a number of manufactures arrow shafts. The annular arrow fletch center elongated cylindrical cylinder is hollow with smooth walls allowing the arrow shaft to be inserted into the center elongated cylindrical cylinder structure until the shaft engages the central elongated cylindrical cylinder cap at a predetermined depth. The center elongated cylindrical cylinder cap recess is smaller in diameter then an arrow shaft to prevent said arrow shafts from passing through the center elongated cylindrical cylinder. The annular arrow fletch central elongated cylindrical cylinder is in the range of 1.6" inches in length. The annular arrow fletch center elongated cylindrical cylinder cap has a metal contact incorporated into or on the cap to aid in conductivity contact. The annular arrow fletch central elongated cylindrical cylinder cap recess is open to except industry standard size arrow nocks, which will allow an arrow nock to be inserted into the recess but not pass completely through the opening. When an arrow nock is inserted through the annular arrow fletch central elongated cylindrical cylinder cap and seated into the aft end of an arrow shaft the annular arrow fletch will be affixed to an arrow shaft. When the annular arrow fletch is affixed with a tight fitting arrow nock to an arrow shaft the annular arrow fletch will not move. The annular arrow fletch has three fins that connect the central elongated cylindrical cylinder to the annular wing. The annular arrow fletch fins are equal in size, shape and distances from each other at 120 degrees. The fins bridge the central elongated cylindrical cylinder to the outer annular wing. The bridging begins at the base of the annular arrow fletch and continues to the full height of the annular wing. The fins are at perpendicular angle disposed substantially orthogonally at the base and zero helical off set. The annular arrow fletch fins have a rounded edges at the base; the fins will have micro-grooves on the topside of each of the 3 fins. The annular arrow fletch fin micro-grooves begin at the base of the fin and continues equaling the height of the annular wing. The annular arrow fletch fin micro-groves run parallel to the central elongated cylindrical cylinder structure. The annular arrow fletch fins and the annular wing will be thicker at the base and taper and become thinner as the heights increases, mimicking an airfoil design. The annular arrow fletch fin micro-groves will direct air over the micro-groves causing the arrow to rotate on the arrow shaft axis when launched from a bow. The annular arrow fletch outer annular wing is in the range of 1.02" inches in diameter and one half (0.5") inches tall.

BRIEF DESCRIPTION OF THE DRAWINGS

Example embodiments are illustrated by way of example and not limitation in the figures of the accompanying drawings, in which like references indicate similar elements and in which: the following drawings are a perspective view of exemplary annular arrow fletch made in accordance with the present invention. The description of the appearance of portions of the annular arrow fletch design which are not illustrated in the below figures such as, the left side elevational view is a mirror image of the right side.

FIG. 3. Clearly depicts the base 106, the center elongated cylindrical cylinder structure 102 and the annular wing 101 of the annular arrow fletch.

Figure 1:
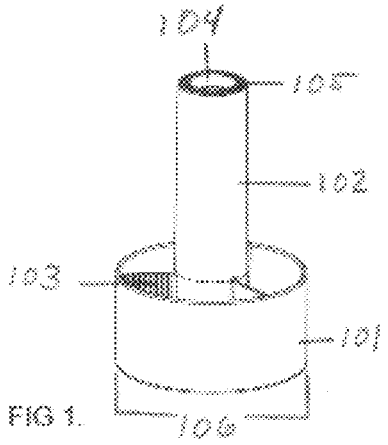
FIG. 1, the annular arrow fletch is set on its base 106 slightly tilted toward the viewer to allow for an offset overview of the invention. This drawing allows for an overview of two of the three fins 107, the micro-grooves 103 and the metal contact 105 on or in the central elongated cylindrical cylinder cap 104.
Figure 2:
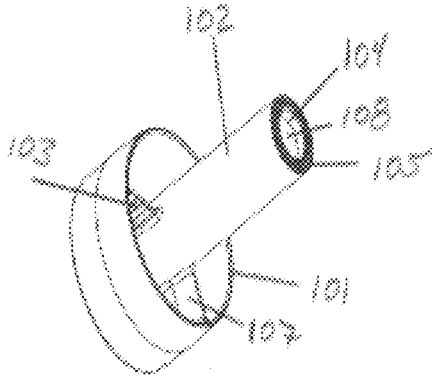
FIG. 2, the annular arrow fletch is set on its base 106 tilted toward the right at a 45-degree angle allowing the viewer an offset overview of the invention. This drawing allows for an overview of two of the three fins 107, the micro-grooves 103 depicted but partially obstructed by the annular wing 101 and the metal contact 105 placement on or in the central elongated cylindrical cylinder cap 104. The recess 108 at the top of center elongated cylindrical cylinder cap 104 is the placement of the arrow nock 601. The central elongated cylindrical cylinder cap 104 partially encloses the top of the center elongated cylindrical cylinder 102 to prevent the arrow shaft 602 from completely passing through the central center elongated cylindrical cylinder structure 102.
Figure 3:
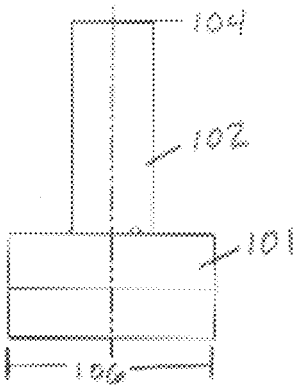
FIG. 3, this drawing is the right side lateral view of the annular arrow fletch. The left side is a mirror of the right side.

Other features of the present embodiments will be apparent from the accompanying drawings and from the detailed description that follows.

DETAILED DESCRIPTION OF EXEMPLARY EMBODIMENTS

Although the present embodiments have been described with reference to specific example embodiments, it will be evident that various modifications and changes may be made to these embodiments without departing from the broader spirit and scope of the various embodiments.

A conventional arrow comprises a tip, a shaft, and a prior art stabilization system comprising a plurality of glued fins as feathers, veins and or fletching's. The fins are fixed to the shaft and are easily damaged or lost through contact with other surfaces, e.g., with the bow used to launch the arrow or with butt material (backing, bales, man made targets or dirt designed to stop and hold arrows) of a paper target, or with a game animal when hunting. The aft end of the arrow may comprise a recess (not shown) formed therein for engagement (e.g., via a interference fit) with an arrow nock that secures the arrow in place on a bowstring before launch, e.g., by disposing an arrow nocked to a bowstring (not shown) within a notched area of the arrow nock.

Turning now to Drawing 1, an exemplary annular arrow fletch in one embodiment of the present invention is illustrated. The annular arrow fletch is field replaceable, reduces assembly labor cost, and significantly improves the stability of arrows. In the embodiment shown, the annular arrow fletch comprises an annular wing 101, pluralities of fins 107, a central elongated cylindrical cylinder structure recess 108 formed within a central elongated cylindrical cylinder structure cap 104, the central elongated cylindrical cylinder structure 102 which is smooth walled formed within the aperture of the annular wing 101. In addition to providing stability, the annular wing 101 may further be adapted to add rigidity to and/or to direct air to the fins 107. The fins 107 have a multiple functions; the fins 107 have micro-grooves 103 on one side serving both as aerodynamic elements and structural elements bridging the annular wing 101 and the central elongated cylindrical cylinder structure 102. The exemplary annular arrow fletch shown is designed to replace conventional fletching, i.e., to be used with an arrow having no other form of fletching. The central elongated cylindrical cylinder structure 102 of the annular arrow fletch is sized to have a diameter larger than that of the shaft of an arrow 602, so that the arrow shaft 602 can be slid therein. The smooth interior walls of the central elongated cylindrical cylinder structure 102 of the invention allow for a semi interference fit with the arrow shaft 602. The interference fit with the arrow shaft 602 is not required for the annular arrow fletch to function. Once the aft end of the arrow shaft 602 is inserted into the central elongated cylindrical cylinder structure of the annular arrow fletch the shaft 602 will recess to a predetermined depth and engage, making contact with the under side of the elongated cylindrical cylinder structure cap 104. The opening in the aft end of the arrow shaft will align with the recess opening in the central elongated cylindrical cylinder structure cap 104 and the arrow nock 601 or lighted arrow nock 601 can be inserted into the central elongated cylindrical cylinder structure cap recess 108. Arrow nocks 601 or lighted arrow nocks 601 are designed to have an interference fit with the inside of an arrow shaft 602. The interference fit will hold the annular arrow fletch in position preventing any movement but allowing the airfoil effects to be imparted onto the arrow in flight. With reference to central elongated cylindrical cylinder structure cap recess 108, is sized to have a smaller diameter than that of the central elongated cylindrical cylinder structure 102 and provides a predetermined depth engagement to the annular arrow fletch with the arrow shaft 602. Alternatively, in a scenario in which it is desirable for the arrow to be able to pass through the target, the interference fit of the arrow nock 601 and the interior of the arrow shaft 602 allows for the means for releasing the annular arrow fletch such that the arrow shaft 602 can pass through the target and the annular arrow fletch and arrow nock 601 will drop to the ground after the arrow shaft 602 completes its travel through the central elongated cylindrical cylinder structure 102 of the annular arrow fletch.

The annular arrow fletch is positioned around the arrow shaft 602 at the aft end of the arrow shaft 602, the arrow may be launched in a conventional manner, the conventional arrow nock 601 positioned on the bowstring. The arrow is then drawn back prior to launch, and the annular arrow fletch remains affixed at a predetermined depth on the aft end of the arrow shaft 602. The archer releases the bowstring with either a mechanical release or with their fingers and the arrow is then launched. As the arrow begins to leave the bow the forward projection of the annular arrow fletch begins to direct wind and/or air resistance. As the arrow travels forward through the arrow drop away rest, for the duration of the flight, thereby providing controlled stabilization, spin, and/or other flight characteristics, e.g., reduced wobble or oscillation of the arrow. The annular arrow fletch is made of more rigid materials then traditional feathers, vane or fletching materials and imparts corrective forces onto the arrow shaft 602 as soon as the arrow nock 601 is leaves the string. Because of the use of more rigid materials the annular arrow fletch can only be shot from properly tuned bows with fall away rests with appropriated clearance.

In contrast, with conventional arrows, the arrow nock 601 must be positioned in a particular orientation or relationship to the fletching, arrow rest and string. An arrow equipped with an annular arrow fletch consistent with the present invention needs no particular orientation or clocking, since there is no risk of the annular arrow fletch annular wing 101 interfering with a fall away arrow rest or any other part of the bow when sufficient clearance has been confirmed prior to shooting an arrow with an annular arrow fletch installed.

The elimination of conventional fletching, tail feathers from the body of arrow shaft, as achieved by the present invention, allows for easy storage of arrows without causing damage to stabilizing surfaces. Typical fletched arrows are delicate and easily become damaged when stored or when used in the field. An annular arrow fletch consistent with the present invention may simply be removed from the arrow shaft 602 and the bare arrow shaft 602 stored without the possibility of fletching damage. Further, a damaged fletching unit may be replaced in the field in seconds, without any loss of accuracy or repeatability. Additionally, since the annular arrow fletch is arrow nock 601 fixed to the arrow during flight and does not require arrow nock pins, the use of toxic glues and other chemicals can be reduced by way of the present invention.

Various changes may be made in the foregoing invention without departing from the spirit and scope thereof. For example, fin 107 tapper or angle to optimize arrow flight for a given application, e.g., for balance, stability, or shootability of the arrow. When the annular arrow fletch is disposed as closely as possible to the trailing end of the arrow shaft 602, the center of the stabilizing force can be situated rearward beyond that of convention fletching and closer to the aft end of the arrow shaft 602 than possible with conventional fletching. Since the stabilizing force or equivalent center of pressure caused by the annular arrow fletch of the present invention may be positioned rearward beyond that of conventional vanes, the force required to produce an equivalent stabilization force decreases, and thus, the total surface area required to produce an equivalent force is reduced. The arrow speed is increased over conventionally fletched arrows due to less frictional drag as a result of the reduced surface area required for stabilization. Further, the decrease in the cross sectional area of the stabilizing surface, the annular wing as compared to conventional vanes, results in less cross wind drift and improved accuracy when shooting in cross winds.

With conventional bow and/or arrow drop away rest designs, it is desirable for the annular arrow fletch to be positioned at the aft end of the arrow shaft 602 and positioned at the end of the arrow prior to launch, so as not to be obstructed by the drop away rest in flight as the arrow passes over the arrow rest. Thus, the annular arrow fletch of the present invention solves the interference issue for all bows in use, even specialized bows and arrow rests already adapted to minimize interference with conventional fletching, and users of such specialized bows and drop away arrow rests may enjoy the same benefits of the present invention as users of conventional bow with drop away rests.

As those skilled in the art will recognize, while the exemplary annular arrow fletch illustrated and described herein above comprises a pair of nested annular structures, an annular arrow fletch consistent with the present invention may comprise a variety of other shapes, sizes and configurations. For example, the annular wing 101 might comprise a square, rectangular, ovular, or other cross section instead of a circular cross-section. Alternatively, instead of an annular wing 101, a plurality of arcuate or straight wing sections not connected to one another might serve as wings, wherein each section is held onto a central elongated cylindrical cylinder structure 102 by means of one or more fins 107 or other support members.

The central elongated cylindrical cylinder structure 102 of the annular arrow fletch and the cylindrical smooth walls formed therein could alternatively comprise other configurations for forming the interference fit with the shaft 602 of an arrow, such as; a plurality of arcuate sections or inward projections on the central elongated cylindrical cylinder 102 appropriately sized for mating with the shaft 602. The annular arrow fletch central elongated cylindrical cylinder annular structure 102 smooth wall interference fit and the arrow shaft 602 could also be accomplished through a number of alternative means, such as; a groove or track configuration, wherein a groove or ridge is formed in or on the shaft 602 of the arrow along its length, and an element (e.g., a groove, notch or projection) adapted to mate with and slide within or along the groove or ridge projects from or is formed in the annular arrow fletch.

While three fins 107 generally provide maximum stability without adding too much weight to the annular arrow fletch and arrow, it should be recognized that the fins 107 of the annular arrow fletch can vary in number, shape, size, angular disposal, and other aspects, and certain embodiments of the annular arrow fletch might not even include any fins 107. The angle(s) at which the fins 107 are mounted may also vary, e.g., various embodiments may include fins 107 angularly fixed relative to the longitudinal axis of the arrow to provide rotational spin force to the arrow; fins 107 fixed parallel to the longitudinal axis of the arrow to prevent the spin of the arrow, e.g., to improve penetration of the arrow into the target; or alternatively, fins 107 fixed parallel to the longitudinal axis of the arrow with an expanding taper design terminating at the trailing edge of the fin 107 to produce rotational spin. Thus, a user can change the flight characteristics from a spinning arrow, which is similar to a bullet shot from a rifled barrel, to a non-spinning arrow, for better target penetration when using certain tips. It is further noted that the number, size and shape of stabilizing fins 107 attached to the annular arrow fletch may vary without interference concerns at the drop away arrow rest or other portions of the bow. Cross-sections of the fins 107 at certain locations thereon may have varying shapes, e.g., airfoil-shaped, micro-groves 103 or tapering cross-sections, to effect various modifications in flight. The fins 107 may be formed with one or more apertures therein, to reduce the weight of the annular arrow fletch and/or for reasons of aerodynamics.

The central elongated cylindrical cylinder 102 interior smooth wall of the annular arrow fletch that create a loose interference fit between the arrow shaft 602 and the central elongated cylindrical cylinder structure 102 during installation engagement there between could alternatively comprise other configurations, e.g., a taper, or a single projection in the form of a flexible O-ring. Such projections, tapers, fingers, O-rings, or similar self-adjustment or self-centering features may further be adapted to permit a single annular arrow fletch to be used with a variety of arrows having shafts of varying dimensions, tolerances, or other characteristics, e.g., by construction using a flexible material, such that the projections expand or contract to create a friction or interference fit with arrow shaft(s) 602 having varying diameters, or even shafts having cross-sections other than circular.

Materials for constructing an annular arrow fletch consistent with the present invention may include one or more metal contacts 105, e.g., aluminum, brass, stainless steel, steel, copper, conductive ink, conductive paint and the body of the invention made of plastics such as; nylon, acrylic, polyethylene, or polypropylene. Such an annular arrow fletch may be manufactured as a one-piece unit or other multi-piece designs, and may be flexible, rigid, semi-rigid, or comprise components of differing materials or having differing rigidity. The annular arrow fletch may be made in a variety of varying lengths, colors, and configurations, and may be manufactured by a number of techniques, e.g., as injection molding, tooled, and or 3-D printing. The annular arrow fletch may comprise luminescent, bioluminescent, electro-luminescent, or photo-luminescent materials for ease of visibility and retrieval, particularly in dark or dull-colored environments.

Those skilled in the art will recognize that an annular arrow fletch consistent with the present invention has utility not only in the field of archery, but may also have utility in improving the flight of other types of projectiles, e.g., a javelin or an atlatl (a device that is used to throw with considerable mechanical advantage a lightweight spear called a dart). It is further noted that a projectile used in conjunction with an annular arrow fletch consistent with the present invention does not necessarily have to be one adapted for air travel, but instead could be a projectile for travel in water (e.g., for bow fishing or spearfishing), or another liquid or gaseous media.

A set of annular arrow fletch having differing dimensions from one another may be provided (differing in, e.g., diameter of the annular wing 101, angular configuration of the fins 107, diameter of the central elongated cylindrical cylinder structure 102, length of the central elongated cylindrical cylinder 102, which may have utility, e.g., when using arrow shafts having differing diameters. Further, a set of annular arrow fletch could comprise a plurality of differently colored annular arrow fletch for ease of individual identification.

Figure 4:
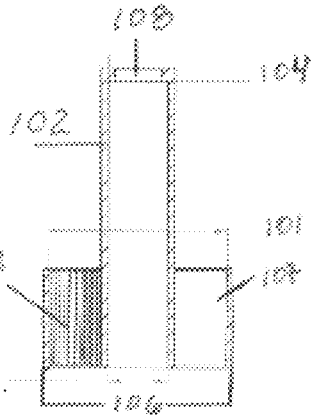
FIG. 4, drawing is the right side cross section of the lateral view of the annular arrow fletch. The drawing displays detail in the construction of the annular arrow fletch such as; the micro-groves 103 on a fin 107, the smooth straight walls of the center elongated cylindrical cylinder structure 102, the annular wing 101 air-foil design thicker material at the base 106 and tapering as the height of the annular wing 101 increases and the elongated cylindrical cylinder cap 104.
Figure 5:
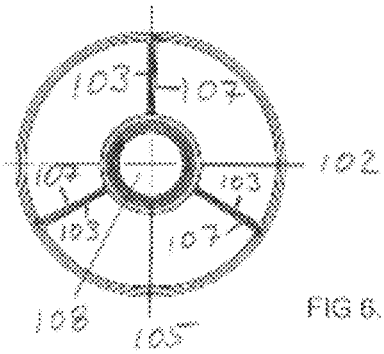
FIG. 5, this drawing is the top view looking down onto the annular arrow fletch. This drawing allows for an overview of the three fins 107, the micro-grooves 103, metal contact 105 placement on or in the center elongated cylindrical cylinder cap recess 108 and the annular wing 101. The center elongated cylindrical cylinder cap recess 108 at the top of center elongated cylindrical cylinder cap 104 is the placement of the arrow nock 601. The center elongated cylindrical cylinder cap 104 partially encircles the top of the center elongated cylindrical cylinder structure 102 to prevent the arrow shaft from completely passing through the center elongated cylindrical cylinder structure 102. The center elongated cylindrical cylinder cap 104 also provides the material base for the placement of the metal contact 105.
Figure 6:
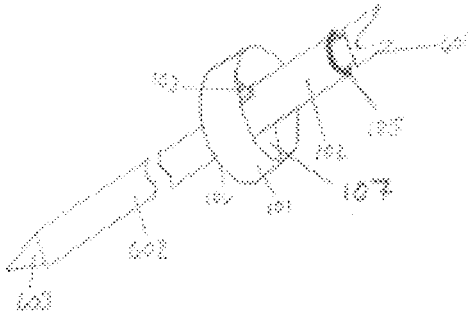
FIG. 6, this drawing depicts the annular arrow fletch appearance if the invention were affixed to the aft end of an arrow shaft 602 and an arrow nock 601 was inserted into to center elongated cylindrical cylinder cap recess 108, at the top of the center elongated cylindrical cylinder cap 104 depicted in this drawing is a dark ring depicting the metal contact 105 of the annular arrow fletch. The arrow components would not be complete without an arrow point 603. Within this drawings the micro-groves 103 are obstructed by the annular wing 101, but two of the three fins 107 are partially in view.

Although the present invention has been set forth in terms of the embodiments described herein, it is to be understood that such disclosure is purely illustrative and is not to be interpreted as limiting. Consequently, without departing from the spirit and scope of the invention, various alterations, modifications, and or alternative applications of the invention will, no doubt, be suggested to those skilled in the art after having read the preceding disclosure. For example, as shown in FIG. 4, the annular arrow fletch annular cross-sections may be tapered to have inner diameters that narrow along the respective lengths of the annular arrow fletch central elongated cylindrical cylinder 102. Also, if desired, one or more apertures may be formed in the fins 107. And, as shown in FIG. 5, the annular wing 101 need not be circular, but may be ovular, airfoil-shaped and or tapered in cross-section.

We claim:

1. A stabilizer for a projectile having a shaft wherein the projectile is at least one of an arrow, a bolt, a javelin, a dart, and a spear; the stabilizer comprising:

a central cylinder that receives the shaft;

and a cap that partially closes the cylinder such that the shaft may not enter through the cap.

2. The stabilizer of claim 1, further comprising an annular wing wherein the cylinder is longer than the annular wing.

3. The stabilizer of claim 1, further comprising an annular wing wherein the annular wing is about 0.5 inches long and the cylinder is about 1.6 inches long.

4. The stabilizer of claim 1, wherein the cap comprises a conductive contact.

5. The stabilizer of claim 1, further comprising an annular wing; and one or more fins that connect the cylinder to the annular wing, wherein at least one surface of the fins has micro-groves.

6. The stabilizer of claim 1, further comprising an annular wing; and one or more fins that connect the cylinder to the annular wing, wherein the fins are affixed to at least one of: the cylinder and the annular wing, at an angle relative to a longitudinal axis of the shaft.

7. A projectile having a shaft wherein the projectile is at least one of an arrow, a bolt, a javelin, a dart, and a spear; the projectile having a stabilizer comprising:

a central cylinder that receives the shaft;

and a cap that partially closes the cylinder such that the shaft may not enter through the cap.

8. The projectile of claim 7, wherein the stabilizer further comprises an annular wing wherein the cylinder is longer than the annular wing.

9. The projectile of claim 7, wherein the stabilizer further comprises an annular wing wherein the annular wing is about 0.5 inches long and the cylinder is about 1.6 inches long.

10. The projectile of claim 7, wherein the stabilizer further comprises an annular wing; and one or more fins that connect the cylinder to the annular wing, wherein at least one surface of the fins has micro-groves.

11. The projectile of claim 7, wherein the cap comprises a conductive contact.

12. The projectile of claim 7, wherein the stabilizer further comprises an annular wing; and one or more fins that connect the cylinder to the annular wing, wherein the fins are affixed to at least one of: the cylinder and the annular wing, at an angle relative to a longitudinal axis of the shaft.

13. A stabilizer for a projectile having a shaft wherein the projectile is at least one of an arrow, a bolt, a javelin, a dart, and a spear; the stabilizer comprising:

at least one annular wing; and a central elongated cylinder that receives the shaft wherein the cylinder length is longer than the annular wing such that the cylinder length spaces the annular wing a distance from an end of the shaft wherein the distance is sufficient to provide clearance from an archer's face.

14. The stabilizer of claim 13, wherein at least one of: the annular wing is about 0.5 inches long and the cylinder is about 1.6 inches long.

15. The stabilizer of claim 13, further comprising a cap that partially closes the cylinder such that the shaft may not enter through the cap.

16. The stabilizer of claim 15, wherein the cap comprises a conductive contact.

17. The stabilizer of claim 13, further comprising one or more fins that connect the cylinder to the annular wing, wherein at least one surface of the one or more fins has micro-groves.

18. The stabilizer of claim 13, further comprising one or more fins that connect the cylinder to the annular wing wherein the fins are affixed to at least one of: the cylinder and the annular wing, at an angle relative to a longitudinal axis of the shaft.

* * * * *